US007108912B2

(12) United States Patent
Huang et al.

(10) Patent No.: US 7,108,912 B2
(45) Date of Patent: Sep. 19, 2006

(54) POLYTETRAFLUOROETHYLENE FIBER AND METHOD FOR MANUFACTURING THE SAME

(75) Inventors: James Huang, Taichung (TW); Chin-Chun Chou, Taichung (TW); Chin-Cha Chou, Taichung (TW); Shia-Chung Chen, Taipei (TW); Wen-I Kuo, Taichung (TW); Lei-Ti Huang, Taichung (TW)

(73) Assignee: Yeu Ming Tai Chemical Industrial Co., Ltd., Taichung (TW)

( * ) Notice: Subject to any disclaimer, the term of this patent is extended or adjusted under 35 U.S.C. 154(b) by 0 days.

(21) Appl. No.: 11/075,465

(22) Filed: Mar. 8, 2005

(65) Prior Publication Data

US 2005/0221084 A1 Oct. 6, 2005

Related U.S. Application Data

(63) Continuation-in-part of application No. 10/958,716, filed on Oct. 4, 2004, now abandoned.

(51) Int. Cl.
*D01F 6/00* (2006.01)

(52) U.S. Cl. ..... 428/364; 428/91; 428/397; 428/422; 428/421; 428/400

(58) Field of Classification Search ..... 428/364, 428/397, 422, 421, 400, 91, 213, 220
See application file for complete search history.

(56) References Cited

U.S. PATENT DOCUMENTS

| | | | | |
|---|---|---|---|---|
| 2,772,444 | A | 12/1956 | Burrows et al. | |
| 3,550,826 | A | 12/1970 | Salmela | |
| 3,953,566 | A | 4/1976 | Gore | |
| 3,981,952 | A * | 9/1976 | Ruddell et al. | 264/147 |
| 4,187,390 | A | 2/1980 | Gore | |
| 4,199,627 | A * | 4/1980 | Weder et al. | 428/7 |
| 5,220,932 | A * | 6/1993 | Blass | 132/321 |
| 5,250,042 | A * | 10/1993 | Torgalkar et al. | 604/333 |
| 5,562,986 | A | 10/1996 | Yamamoto et al. | |
| 5,957,690 | A * | 9/1999 | Bartee et al. | 433/215 |
| 6,080,472 | A * | 6/2000 | Huang et al. | 428/315.5 |
| 6,133,165 | A | 10/2000 | Tamaru et al. | |
| 6,235,388 | B1 * | 5/2001 | Yamamoto et al. | 428/364 |
| 6,299,960 | B1 * | 10/2001 | Weder | 428/91 |
| 6,440,557 | B1 * | 8/2002 | Naghibi | 428/397 |
| 6,491,997 | B1 * | 12/2002 | Weder | 428/91 |
| 6,884,505 | B1 * | 4/2005 | Shoemaker | 428/364 |
| 6,949,287 | B1 * | 9/2005 | Huang et al. | 428/364 |

FOREIGN PATENT DOCUMENTS

| | | |
|---|---|---|
| EP | 1 439 247 A1 | 7/2004 |
| WO | WO 96/00807 | 1/1996 |

* cited by examiner

*Primary Examiner*—N Edwards
(74) *Attorney, Agent, or Firm*—Hamre, Schumann, Mueller & Larson, P.C.

(57) ABSTRACT

A polytetrafluoroethylene (PTFE) fiber includes a filament obtained by partially slitting an oriented PTFE film in a lengthwise direction of the film. Emboss processing is conducted linearly along the lengthwise direction of the film and like a zigzag shape or a convexo-concave shape in a width direction of the film, followed by slitting, whereby the filament includes a network structure in which single fibrils that are opened partially are arranged regularly. A PTFE short fiber is obtained by cutting the above filament and includes a branch structure. Thereby, a PTFE fiber with a small average fineness of single fibrils, a uniform fineness and a single-peak distribution with the peak at a center of fineness and with a high production yield and uniform and stable branch structure can be provided and a method for manufacturing the PTFE fiber can be provided.

11 Claims, 10 Drawing Sheets

$A_0$–$B_0$ = 3mm $A_0$–$A_1$ ⟷ Direction = 0.5mm

↕ Direction = 3mm

Represents an area of 1cm$^2$

POLYTETRAFLUOROETHYLENE FIBER AND METHOD FOR MANUFACTURING THE SAME

This is a Continuation-in-part of U.S. patent application Ser. No. 10/958,716, filed Oct. 4, 2004 now abandoned.

FIELD OF THE INVENTION

The present invention relates to polytetrafluoroethylene (PTFE) fibers and a method for manufacturing the same.

BACKGROUND OF THE INVENTION

Since PTFE resins have a relatively high melting viscosity and are not dissolved by most solvents, fibers cannot be produced by a generally adopted method such as extrusion spinning of molten resins and resin solutions. Therefore, various specific manufacturing methods have been adopted conventionally. U.S. Pat. No. 2,772,444 proposes a method for manufacturing a PTFE fiber by emulsion spinning of a mixed solution of an aqueous dispersion solution of PTFE fine particles and viscose, followed by sintering of the PTFE at high temperatures to remove the viscose by thermal decomposition. However, the manufacturing cost of the PTFE by this method is high, whereas the strength of the fiber obtained is low, and therefore the strength of a product obtained by processing this fiber as a raw material also is low.

U.S. Pat. No. 3,953,566 and U.S. Pat. No. 4,187,390, for example, propose a method for manufacturing a high-strength PTFE fiber by slitting a PTFE film or sheet into a minute width, followed by stretching of the obtained tape. However, this method has a difficulty in maintaining a width of the tape obtained by slitting uniformly along the lengthwise direction. Also, there exists a problem that an end portion of the tape tends to be a fibril. For these reasons, there exists another problem that the fiber may break partially during the step of stretching the tape to a high degree.

U.S. Pat. No. 5,562,986 proposes a method for manufacturing cotton-like materials made of PTFE fibers having a branch structure by opening a uniaxially oriented article, specifically a uniaxially oriented film of a molded PTFE article by a mechanical force using a pin roll with a needle density of 20 to 100 needles/cm$^2$. According to this method, however, the length of the obtained PTFE fibers mostly is not more than 150 mm, and it is difficult to obtain a PTFE filament.

WO96-00807 proposes a method for manufacturing cotton-like materials made of PTFE fibers having a branch structure by opening a uniaxially oriented film of a molded PTFE article with a mechanical force. According to this method, however, the density of the obtained PTFE fibers has a high specific gravity exceeding 2.15 g/cm$^3$, thus making it difficult to obtain a light-weight final product.

In the case where the afore-mentioned PTFE oriented film is supplied to a revolving pin roll so as to produce a PTFE fiber, problems occur such as difficulty in making a single fibril thinner, nonuniform fineness and the occurrence of many losses from the end portions of the film supplied. Furthermore, a network structure of the filament is not uniform and therefore a branch structure of a branched PTFE short fiber obtained by cutting the filament also is not uniform and not stable.

SUMMARY OF THE INVENTION

Therefore, with the foregoing in mind, it is an object of the present invention to provide a PTFE fiber in which single fibrils have a small average fineness and have uniform fineness and to provide a method for manufacturing the PTFE fiber. Furthermore, it is another object of the present invention to provide a PTFE fiber in which a fiber can be manufactured from the overall width of a film, that has a high production yield and whose branch structure is uniform and stable and to provide a method for manufacturing the PTFE fiber.

A polytetrafluoroethylene (PTFE) fiber of the present invention includes a filament obtained by partially slitting an oriented PTFE film in a lengthwise direction of the film. Emboss processing is conducted linearly along the lengthwise direction of the film and like a zigzag shape or a convexo-concave shape in a width direction of the film, followed by slitting, whereby the filament includes a network structure in which single fibrils that are opened partially are arranged regularly.

Another PTFE fiber of the present invention includes a short fiber including a branch structure that is obtained by cutting the above filament.

A method for manufacturing a PTFE fiber of the present invention, in which an oriented PTFE film is slit in a lengthwise direction of the film so as to manufacture a filament, includes the steps of: conducting emboss processing of the oriented film, the emboss processing being applied linearly along the lengthwise direction of the film and applied like a zigzag shape or a convexo-concave shape in a width direction of the film; and then, feeding the film to a revolving pin roll with needles so as to slit the film partially in the lengthwise direction. The filament obtained includes a network structure in which single fibrils are opened partially and are arranged regularly.

DETAILED DESCRIPTION OF THE INVENTION

Figure 1:
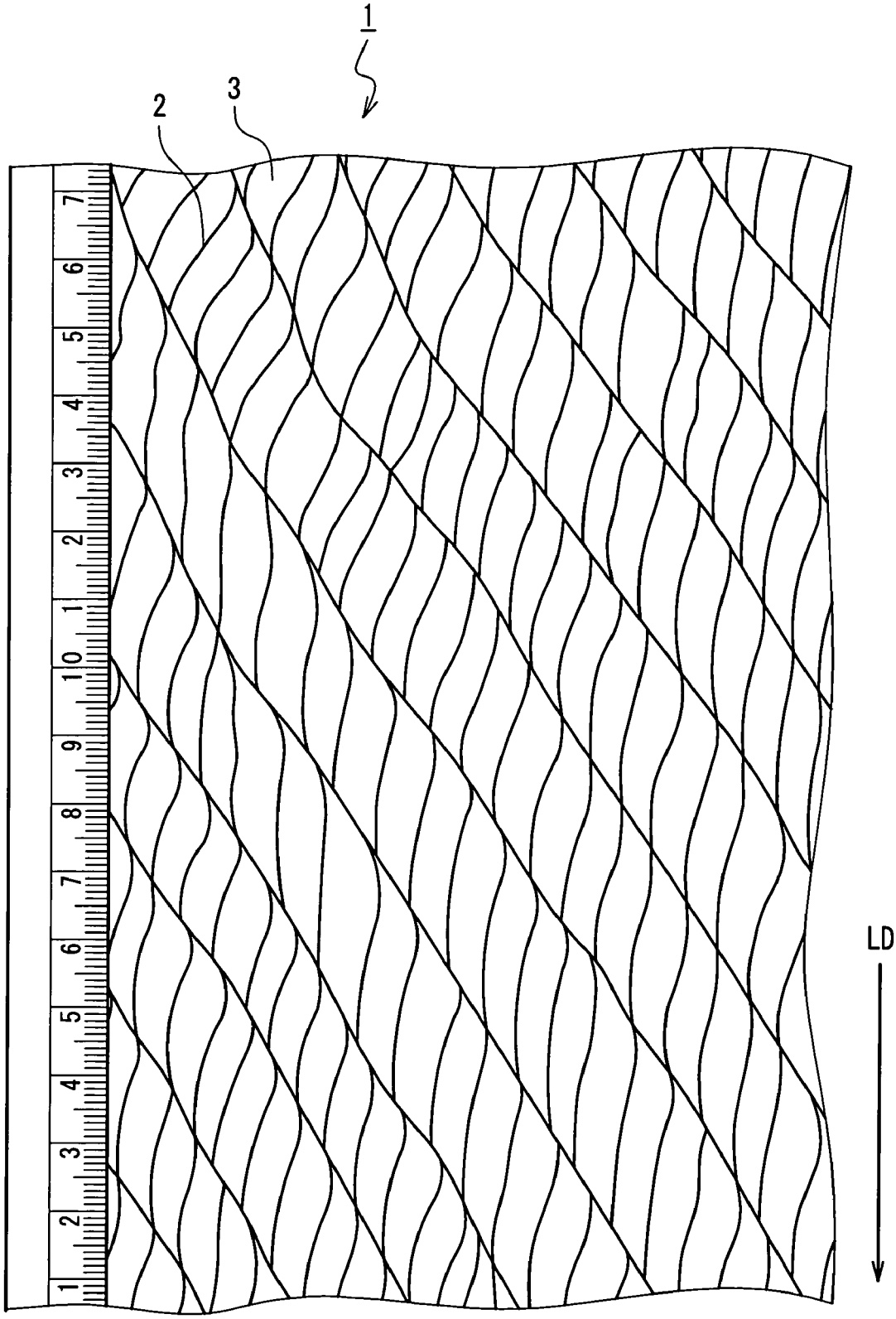
FIG. 1 shows a network structure of a PTFE filament that uses a uniaxially oriented film of Working Example 1 of the present invention.
Figure 2:
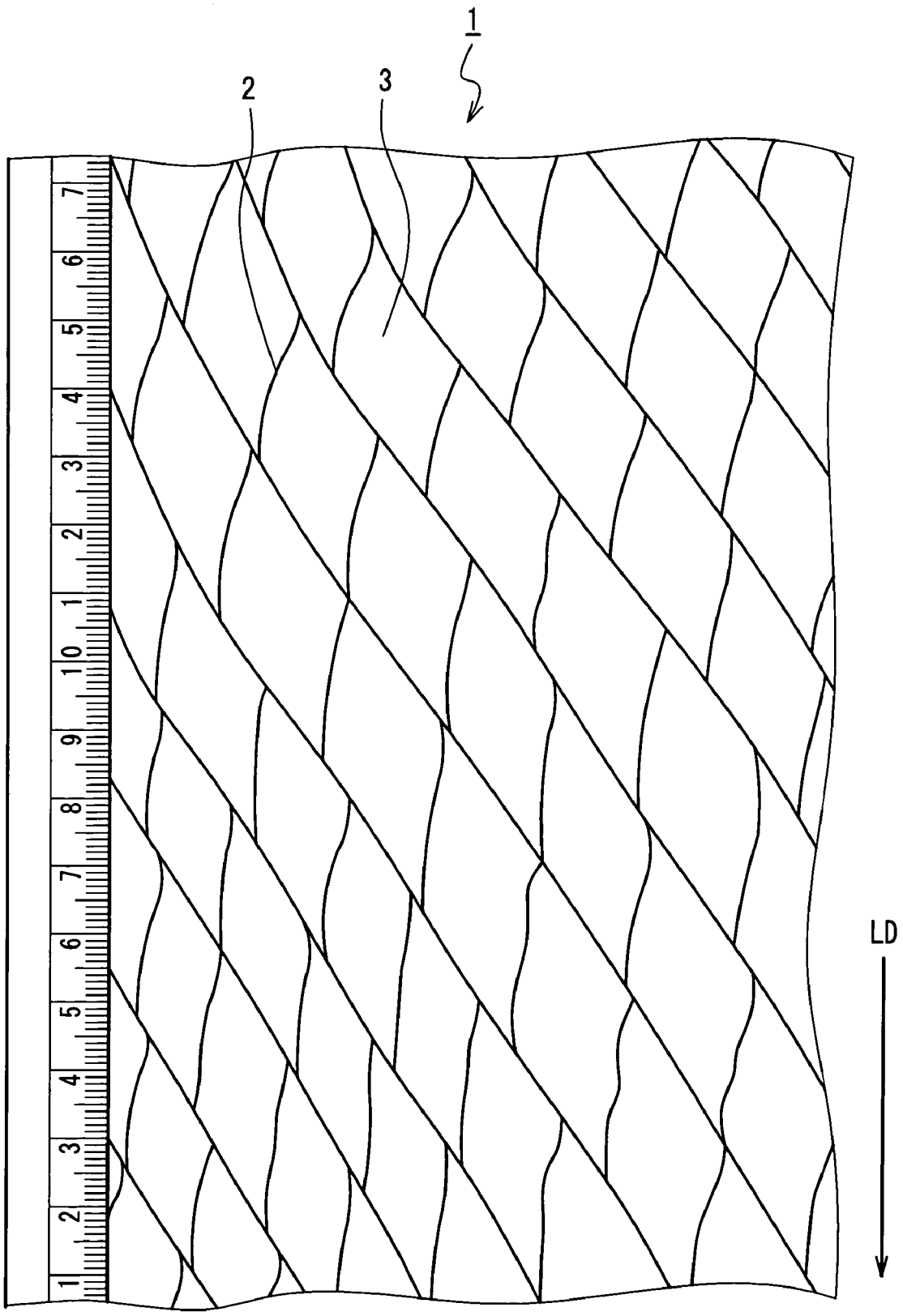
FIG. 2 shows a network structure of a PTFE filament that uses a biaxially oriented film of Working Example 5 of the present invention.

A fiber of the present invention is a slit fiber having a fibril structure, and when the fiber is extended in the width direction, the resultant forms a network structure in which single fibrils are opened partially. That is to say, a PTFE film is slit and is opened so that single fibrils form a network structure. The network structure is as shown in FIG. 1 and FIG. 2 as examples. The figures represented with the scale on the left side of FIG. 1 or 2 are in the unit of centimeters. The size and the shape of the network may vary according to the stretching magnification of the PTFE film subjected to the slitting and the shape of emboss given to the PTFE film. However, the overall shape of the network structure is uniform and stable. A length of a single fibril constituting the network structure ranges from 3 mm to 50 mm, as one example, and preferably ranges from 5 mm to 30 mm. A size of one single fibril ranges from 10 μm×7 μm to 50 μm×20 μm (long axis×short axis), as one example.

In the present invention, a single fibril means a fiber that cannot be split any more. In the case of constituting a filament, the single fibril is one fiber constituting a network structure. In a short fiber obtained by cutting this filament in the direction perpendicular to the length direction, the single fibril is a main chain or a branch of the fiber.

The filament of the present invention is composed of these single fibrils. A fineness of this filament preferably is 0.5 to 600 dtex. In addition, the slit fiber of the present invention preferably has a flat shape and has a thickness of 5 μm to 450 μm. More preferable thickness ranges from 10 μm to 400 μm. The flat shape mentioned herein refers to a ribbon-like shape being rectangular in cross section.

The average fineness of the single fibrils constituting the PTFE fiber of the present invention may be not more than 4.5 dtex, more preferably not more than 4 dtex. Since emboss processing has not been conducted conventionally, a single fibril exceeding 5 dtex only is obtained. Therefore, the present invention is advantageous over the prior art because it enables a finer fiber.

Furthermore, the distribution of fineness of single fibrils constituting the PTFE fiber of the present invention is a single-peak distribution with the peak at the center. Thereby, a PTFE fiber with an excellent uniformity of fineness can be provided. Herein, the single-peak distribution with the peak at the center of the fineness means that, among a large number of measured samples, the number of samples with finenesses closer to the average fineness is the largest, and the number of samples decreases gradually with increasing deviation from the average fineness.

According to the present invention, a PTFE oriented film obtained from PTFE fine powders as a raw material by an emulsion polymerization method is subjected to emboss processing, where the emboss processing is carried out continuously both in its lengthwise direction and its width direction. This film is fed to a revolving pin roll so as to be opened mechanically. In this way, the technical problems are solved.

The PTFE film can be manufactured by conventionally known methods. That is, a mixture of PTFE fine powders and a petroleum oil as an extrusion aid is subjected to a paste extrusion method, so that a continuously extruded article in a rod, bar or sheet shape is molded. Next, this extruded article is rolled into a film form using a calendering roll, and then extraction using a solvent or heat treatment is applied to the rolled film so as to remove the extrusion aid, whereby a PTFE original film is obtained.

A mixing ratio by weight of the PTFE fine powders and the extrusion aid normally ranges from 80:20 to 77:23, and a reduction ratio (RR) of the paste extrusion is not more than 500:1. A heating method often is adopted for removing the extrusion aid, and its temperature is not more than 300° C. and preferably is from 250° C. to 280° C.

The PTFE fiber of the present invention basically is configured by stretching the afore-mentioned original film, followed by emboss processing of the oriented film, the emboss processing being carried out continuously both in its lengthwise direction and its width direction, and then by feeding this film to a revolving pin roll so as to conduct opening by slit processing. The embodiments of the present invention, however, may include various steps as in the following examples:

(1) original film-stretching-emboss processing-slit processing
(2) original film-stretching-heat treatment-emboss processing-slit processing
(3) original film-heat treatment-stretching-emboss processing-slit processing The afore-mentioned emboss processing and slit processing preferably are conducted successively in view of the efficiency of productivity.

The original film may be stretched uniaxially or biaxially.

In the case of the uniaxial stretching, the film is stretched by 4 times or more in the lengthwise direction (LD), preferably by 6 times or more. The larger the degree of the stretching is, the higher the strength of the PTFE fiber obtained.

In the case of the biaxial stretching, the degree of stretching in the LD is 4 times or more, preferably 6 times or more, and the degree of stretching in the width direction (TD) of the film perpendicular to the LD is from 1.5 times to 5 times, inclusive, preferably from 2 times to 3 times, inclusive.

The biaxially stretching may be conducted concurrently in the LD direction and the TD direction or may be conducted as two-stage stretching in which the stretching in the TD direction follows the stretching in the LD direction. Upon the opening of the biaxially-oriented film, a relatively low-density PTFE fiber can be obtained, which leads to an advantage in reducing the cost per volume of the fiber and its finished articles.

The film subjected to the opening step following the emboss processing may be any one of the non-baked film, the semi-baked film and the baked film. However, in terms of the handleability of the fiber, the semi-baked or baked film is preferable, because a tendency of the generated. PTFE fiber to form lumps can be reduced.

Herein, differences in properties among a non-baked, a semi-baked and a baked PTFE films are explained below, with reference to FIGS. 11A to C, which are thermal behavior charts by means of a differential scanning calorimeter (DSC).

Figure 11A:
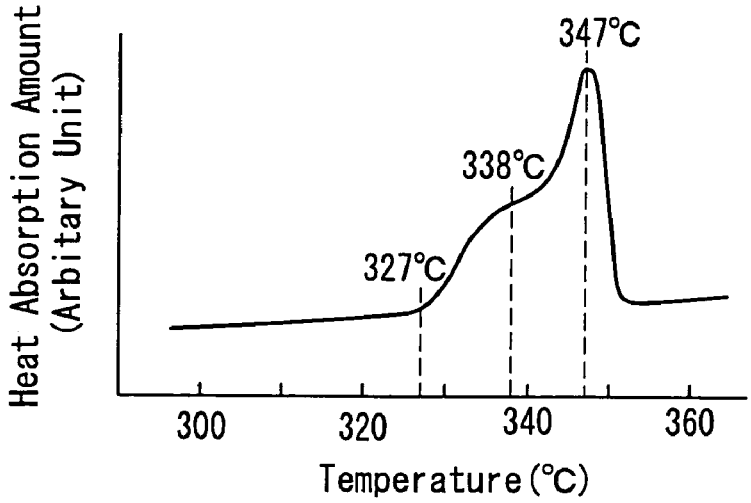
FIG. 11A is a thermal behavior chart of a non-baked PTFE film.

FIG. 11A is a thermal behavior chart of a non-baked PTFE film, where shoulder parts are present at around 327° C. and 338° C., and the main peak of the heat absorption is at around 347° C.

Figure 11B:
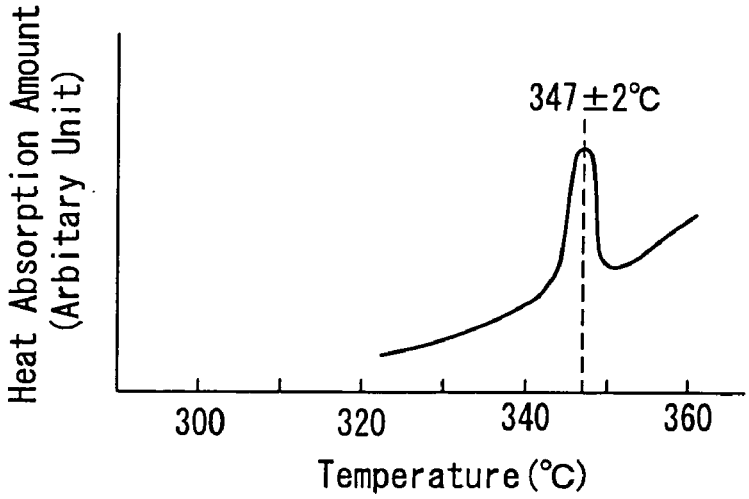
FIG. 11B is a thermal behavior chart of a semi-baked PTFE film and FIG. 11C is a thermal behavior chart of a baked PTFE film.

FIG. 11B is a thermal behavior chart of a semi-baked PTFE film, where the shoulder parts at around 327° C. and 338° C. disappeared and the single heat absorption peak is present at around 347° C.±2° C. This semi-baked PTFE film can be obtained by a heat treatment conducted in the temperature range of 327° C. to 350° C. or by a heat treatment conducted at a temperature of 350° C. or higher for a short time period.

Figure 11C:
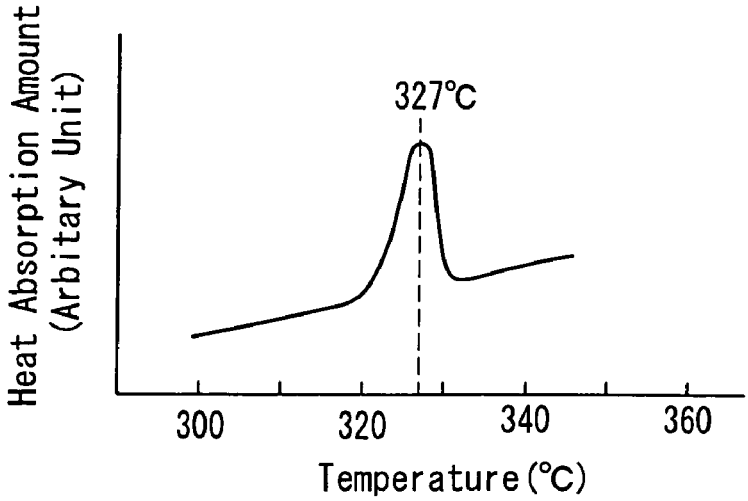

FIG. 11C is a thermal behavior chart of a baked PTFE film, where the single heat absorption peak is present at around 327° C. This is the heat absorption peak by the melting of PTFE crystals. This baked PTFE film can be obtained by a heat treatment conducted at a temperature of 350° C. or higher, and preferably at a temperature of 370° C. or higher.

A thickness of the PTFE film fed for the opening ranges from 5 μm to 450 μm, and preferably ranges from 10 μm to 400 μm.

The pattern of the emboss processing may be linear in the lengthwise direction of the oriented PTFE film and may be continuous both in the lengthwise direction and in the width direction. In the linear emboss processing, a pitch interval between a crest and an adjacent crest in a zigzag-shape or a convexo-concave shape preferably is in the range of 0.1 mm to 1.5 mm, more preferably in the range of 0.2 mm to 1.0 mm and particularly preferably in the range of 0.3 mm to 0.7 mm. In the linear emboss processing, a vertical interval of the zigzag shape or the convexo-concave shape (an interval between the crest and the trough) preferably is in the range of 0.2 mm to 1 mm, more preferably in the range of 0.3 mm to 0.8 mm. Such an emboss pattern can be given by means of a roll for emboss processing.

In the present invention, "linearly" as applied to the linearly emboss processing does not refer to a straight line in a strict sense, but refers to linear that can enhance the emboss processability. Therefore, the "linearly" should be interpreted broadly.

Figure 3A:
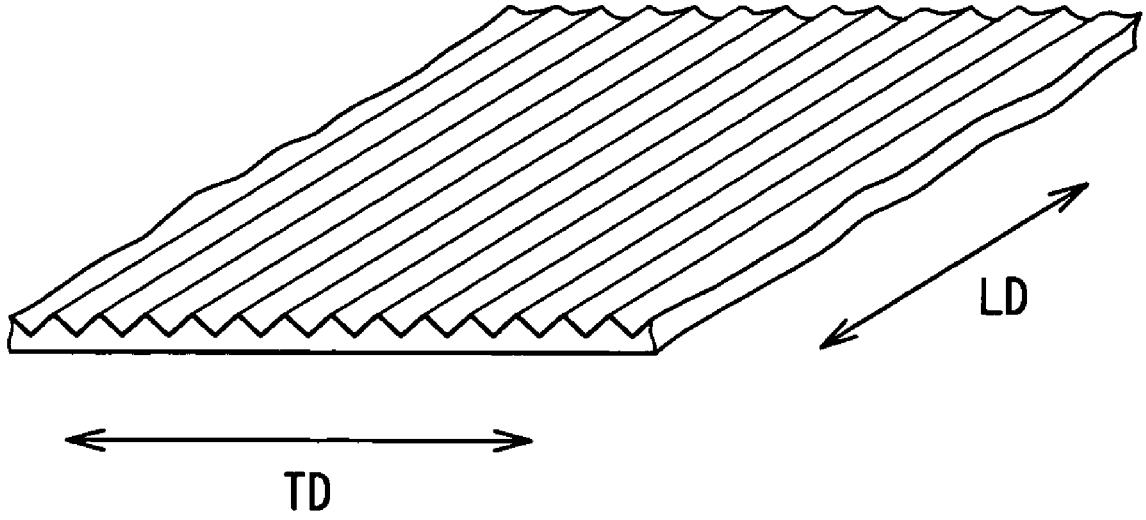
FIGS. 3A to 3B show emboss patterns of Working Example 1 of the present invention.
Figure 3B:
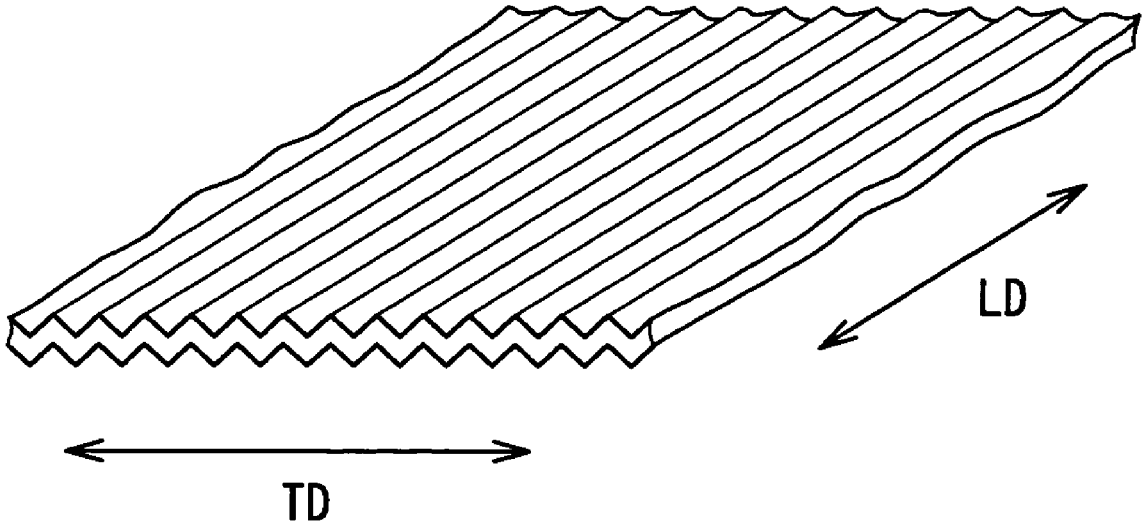

FIGS. 3A and 3B show examples of preferable emboss patterns of the present invention. FIG. 3A shows an example where an emboss pattern is applied to one side of an oriented PTFE film. This can be formed by increasing the hardness of an elastic roll 32 (rubber roll, described later referring to FIG. 4) and by decreasing a linear pressure of the same. FIG. 3B shows an example where an emboss pattern is applied to both sides of an oriented PTFE film. This can be formed by decreasing the hardness of the elastic roll 32 (rubber roll, described later referring to FIG. 4) and by increasing the linear pressure of the same. In FIGS. 3A and 3B, an arrow LD indicates the lengthwise direction of the oriented film (winding direction) and an arrow TD indicates the width direction of the film.

Figure 4A:
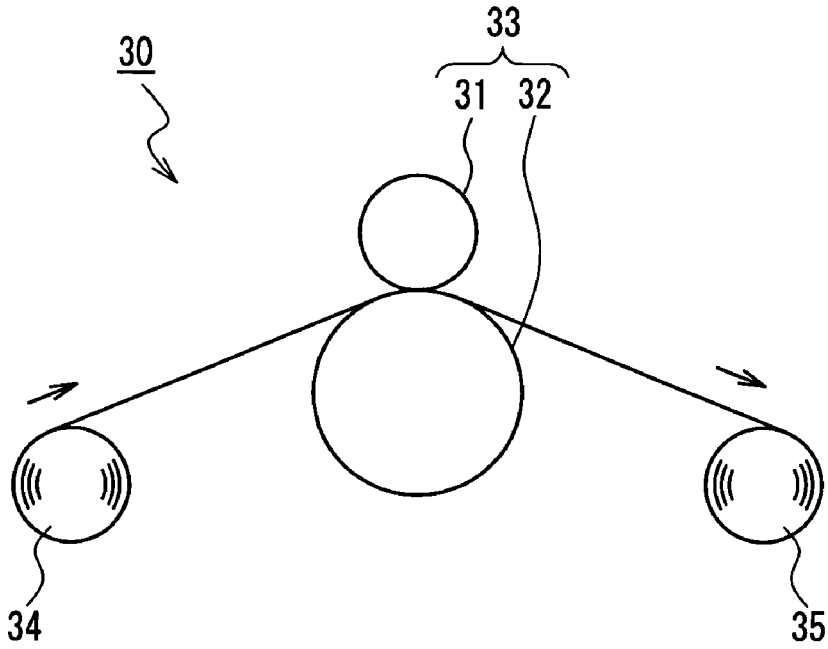
FIG. 4A schematically shows the emboss processing procedure in one embodiment of the present invention.

FIG. 4A schematically shows the emboss processing procedure in one embodiment of the present invention. An emboss roll 33 of an embossing apparatus 30 is made up of a roll 31, made of steel, on which a predetermined zigzag or convexo-concave pattern is engraved, and the elastic roll 32. The elastic roll 32 may be a compressed paper roll, a compressed cotton roll or rubber roll that has elasticity. A PTFE film is sent out of a feeder 34 so as to pass between the steel roll 31 and the elastic roll 32 making up the emboss roll 33, whereby the pattern is given to the PTFE film, which is then wound around a winder 35. The linear pressure of the emboss roll during the emboss processing preferably is in the range of 0.1 to 1.5 kg/cm. The emboss processing may be carried out at a room temperature (about 25° C.).

Figure 4B:
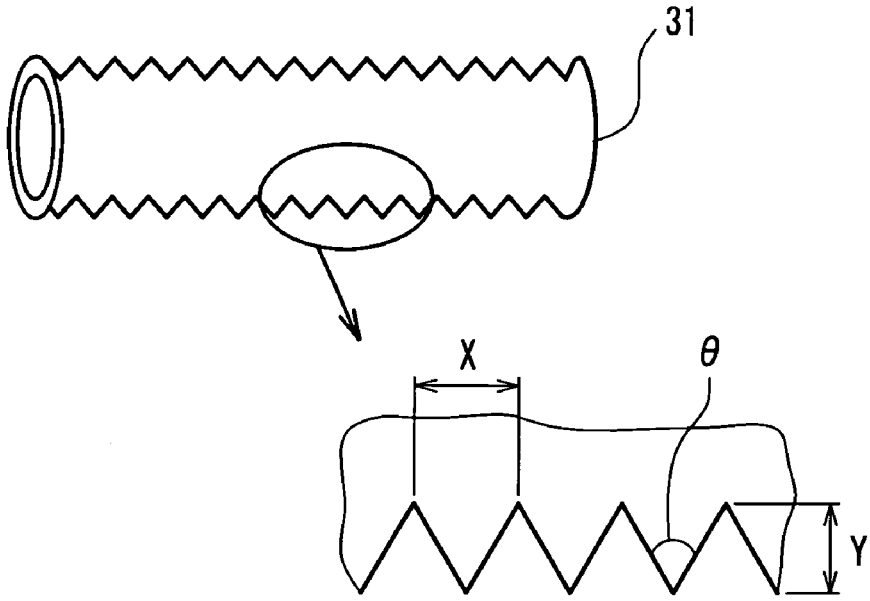
FIG. 4B shows an emboss roll in cross section and an enlarged cross-sectional view of the same.

FIG. 4B shows the steel emboss roll 31 in cross section and an enlarged cross-sectional view of the same. In this example, the surface of the emboss roll has a zigzag shape, where a pitch interval X between a crest and an adjacent crest is 0.1 to 1.5 mm, a vertical interval Y is 0.2 mm to 1 mm and an angle θ of the zigzag is in the range of 15° to 60°.

When the oriented PTFE film with the emboss processing applied thereto is opened, the opening to the end portions of a broad film can be conducted easily without undue opening force and a regular network of single fibrils can be formed.

Note here that the pattern of the afore-mentioned emboss roll does not remain in the fiber obtained by opening the oriented PTFE film on which the emboss processing has been conducted.

Figure 6:
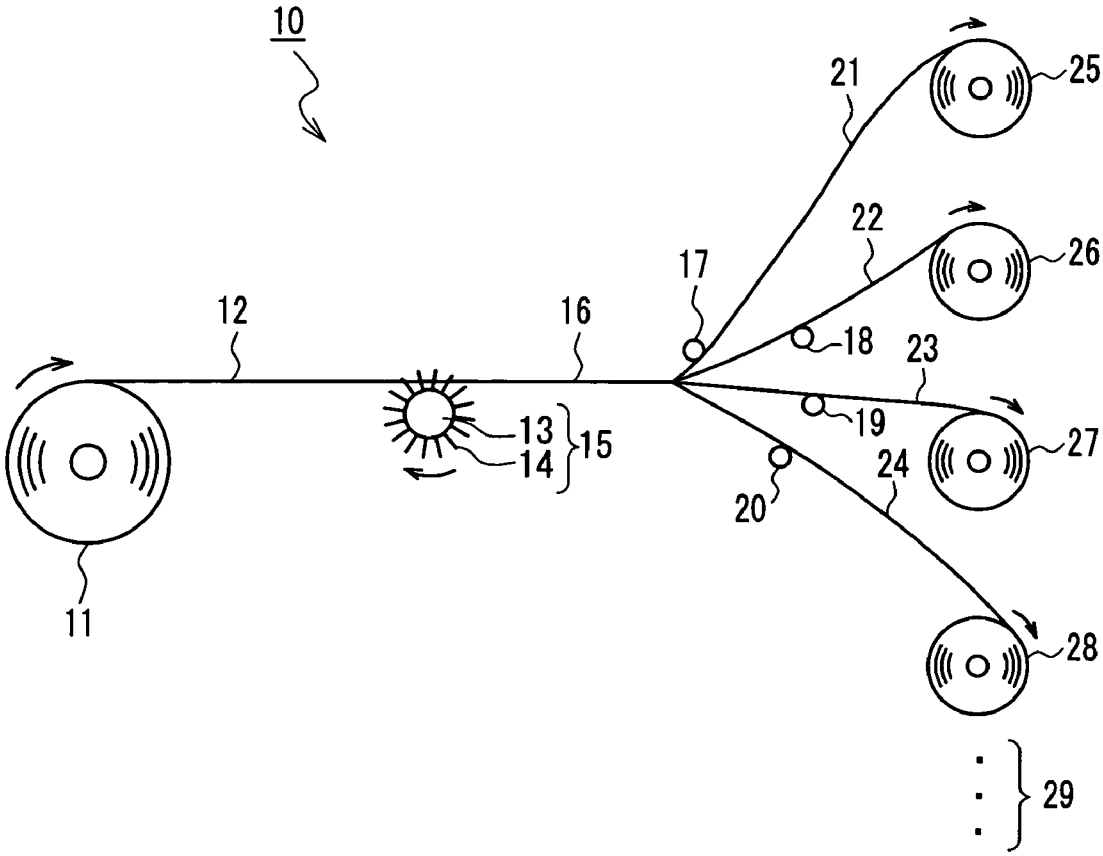
FIG. 6 shows an apparatus for manufacturing a PTFE filament of one example of the present invention.

The manufacturing of a PTFE filament by opening will be described below. In the present invention, a filament means the fiber having a length substantially equal to that of the PTFE film fed for the opening. The supplied film may have any length, and as one example, a length of about 1,000 m to 10,000 m is practical. A pin-roll or a pair of pin-rolls may be used for the opening. The diameter of needles on the pin-roll used ranges from 0.3 mm to 0.8 mm, and the length of the needles ranges from 0.5 to 5 mm. A density of needles is from 3 to 25 needles/$cm^2$, preferably from 3 to 15 needles/$cm^2$, and more preferably from 4 to 10 needles/$cm^2$. If the density of needles exceeds 25 needles/$cm^2$, a PTFE filament cannot be obtained, resulting in the generation of short fibers with a length not more than about 50 mm to 200 mm. FIG. 6 shows a preferable example of the needle arrangement on a surface of the pin-roll. The arrangement is not limited to this. The pin-roll rotates at a peripheral speed of 50 to 500 m/min, preferably at 60 to 300 m/min. A feeding speed of the stretched and emboss-patterned PTFE film is from 10 to 100 m/min, preferably from 20 to 60 m/min.

Figure 5:
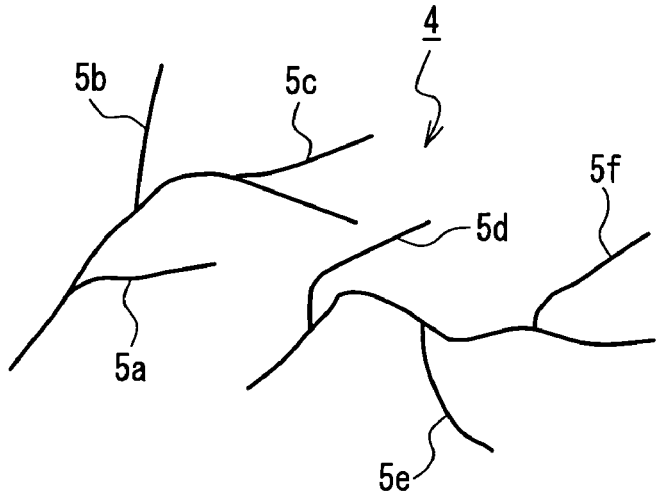
FIG. 5 shows a structure of a PTFE short fiber of one example of the present invention.

Short PTFE fibers can be manufactured by cutting the PTFE fiber having a network structure obtained from the above opening process into any length depending on the purpose of the application and the intended use. When short fibers are to be formed, the fibers are cut into a length of about 30 mm to 100 mm, preferably of about 50 mm to 80 mm. At this time, the network structure of the PTFE filament is broken, so that the short PTFE fibers assume branch-structured short fibers 4 as shown in FIG. 5. Branches 5*a* to 5*f* of the branch-structured short fibers 4 have substantially the same length and have excellent uniformity.

The PTFE filament and the short PTFE fiber of the present invention can be processed into application products that are required to have heat resistance, chemical stability and the like.

According to the present invention, emboss processing is conducted on a uniaxially oriented or a biaxially oriented PTFE film, which is then processed into a slit yarn, whereby a PTFE fiber with a small average fineness of single fibrils, a uniform fineness and a single-peak distribution with the peak at a center of the fineness and a method for producing the PTFE fiber can be provided. Furthermore, a PTFE fiber in which a fiber can be manufactured from the overall width of a film, having a high production yield and a uniform and stable branch structure can be provided and a method for manufacturing the PTFE fiber can be provided.

Furthermore, according to the manufacturing method of the present invention, a high-strength PTFE fiber having a specific network structure can be manufactured stably with a simple process and at a relatively low cost.

WORKING EXAMPLES

The following describes the present invention more specifically by way of working examples.

(Manufacturing of PTFE Original Film)

To 80 mass parts of PTFE fine powders obtained by an emulsion polymerization method, 20 mass parts of naphtha was mixed. This mixture was subjected to paste extrusion through a die with an angle of 60° under the condition of RR of 80:1 so as to obtain a circular bar with a diameter of 17 mm. This extruded article was rolled between a pair of rolls with a diameter of 500 mm, followed by the removal of the naphtha at a temperature of 260° C. The thus obtained PTFE film had a length of about 250 m, a film thickness of 0.2 mm and a width of about 260 mm.

Working Example 1

The PTFE original film obtained by the above-stated process was uniaxially stretched by 12 times in the lengthwise direction. Thereafter, this film was heat-treated at 380° C. for 3 seconds. Thereby, a baked film of 0.2 mm in film thickness and 260 mm in width was obtained. Then, by using the emboss roll having the emboss pattern shown in FIG. 3A and the apparatus of FIG. 4, a zigzag pattern was given to the PTFE film, the zigzag pattern having a pitch interval X between a crest and an adjacent crest of 0.5 mm, a vertical interval Y of 0.6 mm and a zigzag angle θ of 45°.

The linear pressure of the emboss roll during the emboss processing was 0.8 Kg/cm. The embossing was applied continuously in the lengthwise direction and in the width direction and all over the film.

Next, the PTFE film was fed to a revolving roll with needles so as to slit the film to be opened, whereby a PTFE filament having a network structure was obtained, the network structure being made up of rhombuses having a ratio between the lengthwise direction and the width direction of about 1:3.

FIG. 6 shows an apparatus for manufacturing the PTFE filament of this working example. In this manufacturing apparatus 10, a PTFE oriented and emboss processed film 12 was sent out of a film feeding roll 11, and the PTFE oriented and emboss processed film 12 was opened by a revolving roll with needles (pin-roll) 15 configured by implanting needles (pins) 14 on a surface of the revolving roll 13, so as to form a network structured fiber 16. Next, the fiber 16 was slit into individual filaments (long fiber) 21 to 24, which then were allowed to pass through guides 17 to 20, respectively, to be wound around the respective winders 25 to 29. The number of winders may be set at any number depending on a design for making a filament with a required fineness from the PTFE oriented and embossed film 12.

Figure 7:
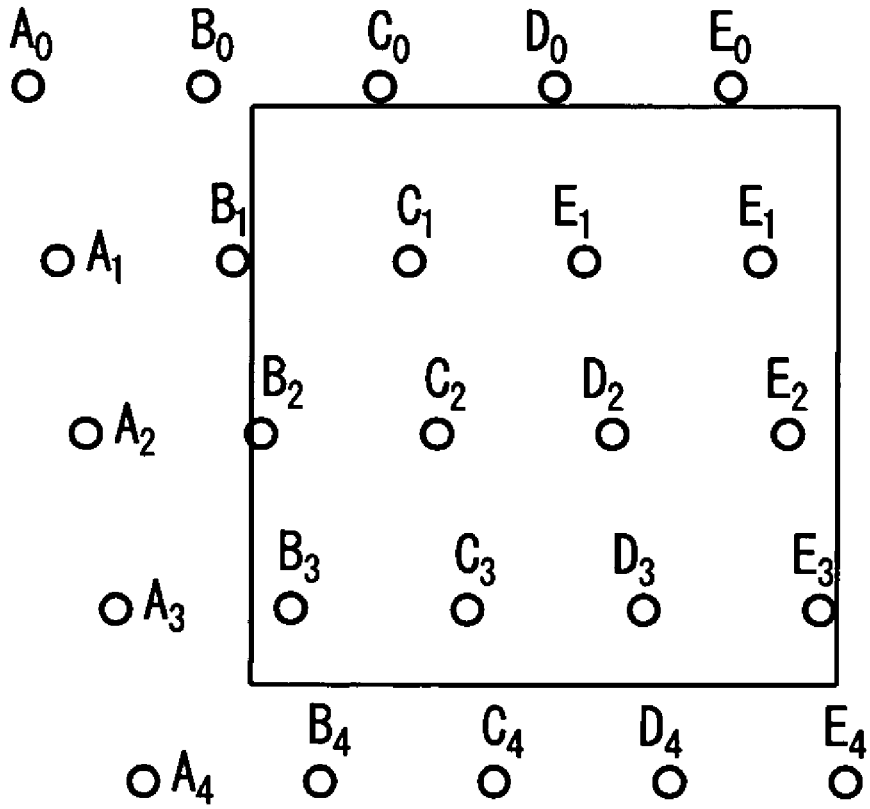
FIG. 7 shows an arrangement of needles on a pin-roll used for manufacturing a PTFE filament of one example of the present invention.

The revolving roll with needles (pin-roll) had a needle density of 6 needles/cm$^2$, a needle length of 5 mm and a roll diameter of 50 mm. In FIG. 7, a distance between needles $A_0$ and $B_0$ (axis direction) was 3 mm, a distance between $A_0$ and $A_1$ in the horizontal direction (axis direction) was 0.5 mm and a distance between $A_0$ and $A_1$ in the vertical direction (circumferential direction) was 3 mm. $A_0$ to $A_4$ run obliquely at regular intervals, and $A_4$ and a row beginning with $B_0$ also run obliquely at regular intervals.

As the conditions of the opening, a peripheral speed of the pin-roll was 200 m/min and a feeding speed of the film was 30 m/min.

A fineness of the filament obtained was 13.3 dtex. When this filament was taken out and was extended in the width direction, the network structure was as shown in FIG. 1. The size of the single fibrils making up this network was 12 μm×8 μm to 35 μm to 20 μm, represented by long side×short side. In FIG. 1, an arrow LD represents the lengthwise direction of the film (winding direction).

Working Example 2

An original film was uniaxially stretched by 9 times in its lengthwise direction, and other conditions were the same as those in Working Example 1 so as to conduct a heat treatment, embossing and opening of the film. Thereby, a PTFE filament having a regular network structure was obtained.

Working Example 3

A PTFE filament was manufactured under the same conditions as those in Working Example 1 except that an original film was stretched by 6 times in its lengthwise direction, and an interval of the emboss pattern was 0.2 mm and a vertical interval of the emboss was 0.3 mm. The fineness of the filament was 24.2 dtex and the filament was composed of single fibrils forming a regular network structure.

Comparative Example 1

Figure 10:
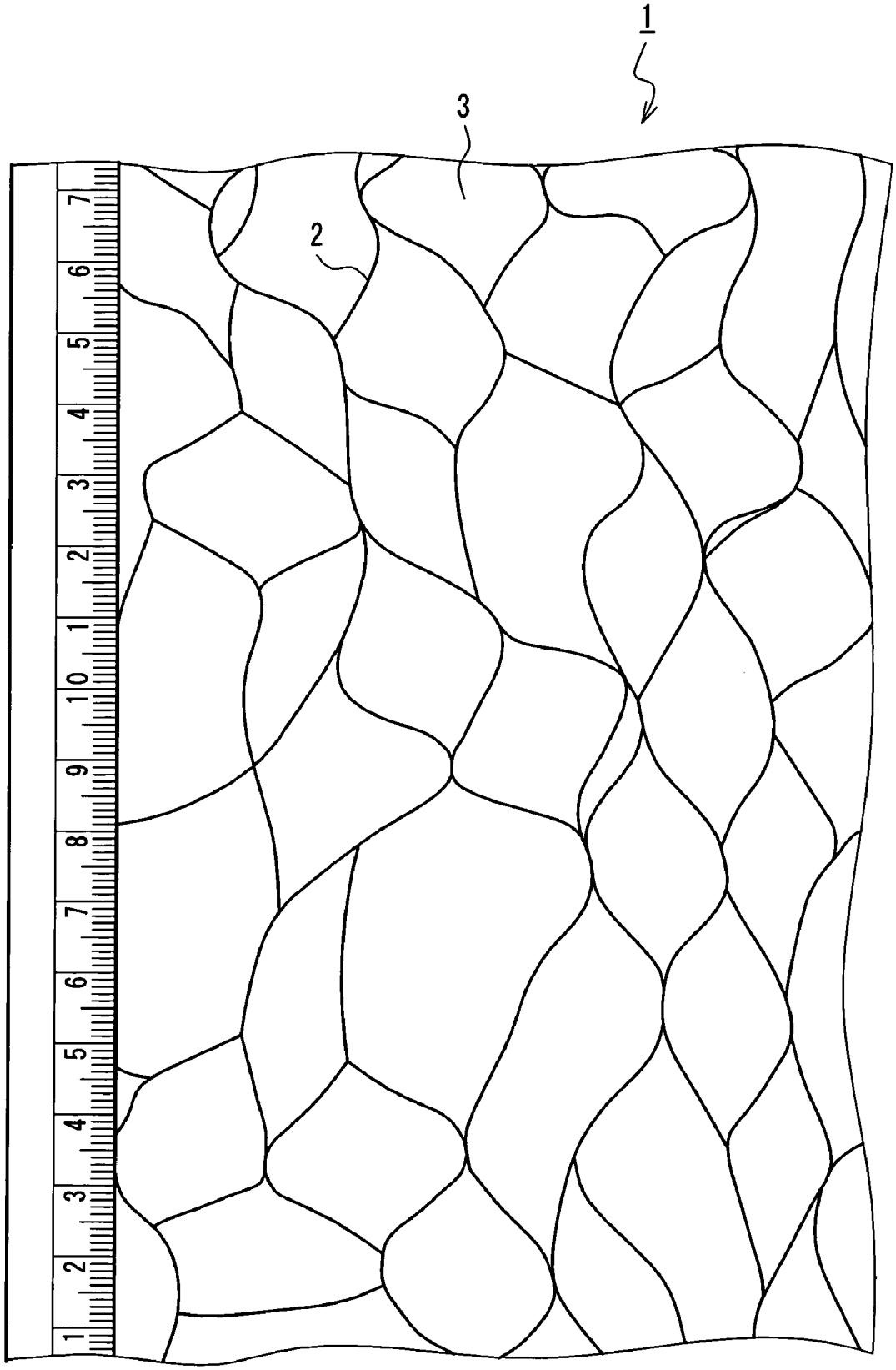
FIG. 10 shows a network structure of a PTFE filament, on which emboss processing is not performed, in Comparative Examples 1 and 2 of the present invention.

A PTFE filament was obtained under the same conditions as those in Working Example 3 except that emboss processing was not performed. The fineness of the filament was 42.3 dtex, which was about twice the fineness of Working Example 3. Furthermore, the network structure of single fibrils had an unstable shape and its size was random as shown in FIG. 10. Reference numerals in FIG. 10 are the same as those in FIG. 1, and therefore their explanations omitted.

Working Example 4

A PTFE original film was biaxially stretched by 8 times in its lengthwise direction and by 3 times in its width direction, and other conditions were the same as those in Working Example 1 so as to conduct a heat treatment, emboss processing and opening of the film. Thereby, a PTFE filament was obtained.

Working Example 5

A PTFE original film was biaxially stretched by 6 times in its lengthwise direction and by 2 times in its width direction. Other conditions were the same as those in Working Example 1 so as to obtain a PTFE filament. The fineness of the PTFE filament was 7.8 dtex and the network structure formed by single fibrils had a rhombus shape with a ratio between the lengthwise direction and the width direction of about 1:1 as shown in FIG. 2. Reference numerals in FIG. 2 are the same as those in FIG. 1, and therefore their explanations omitted.

Figure 8:
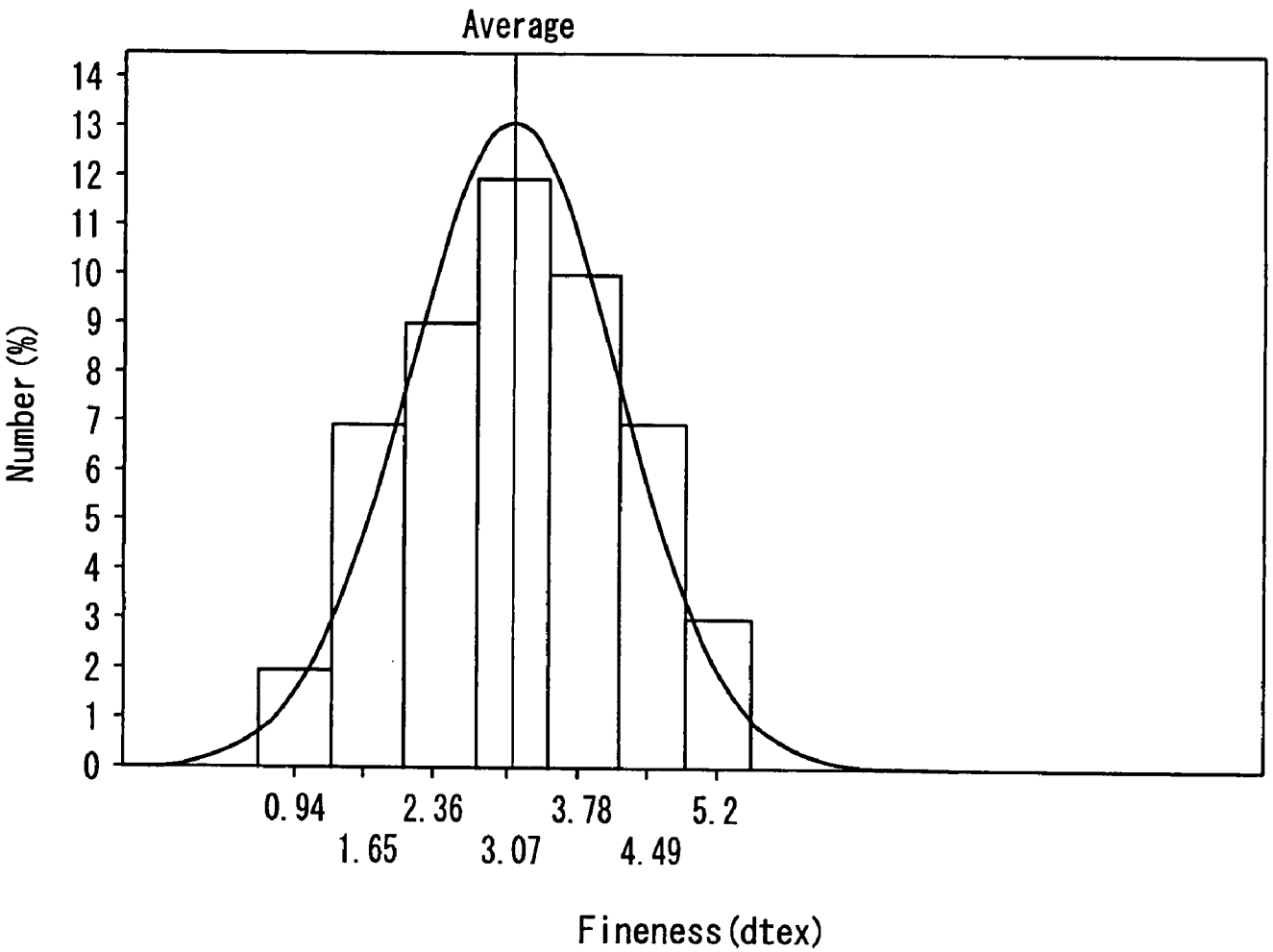
FIG. 8 is a graph showing the fineness distribution of single fibrils of the filament obtained from Working Example 6 of the present invention.

When the fineness distribution of single fibrils of the thus obtained filament was measured, the distribution shown by the graph of FIG. 8 was obtained. The number of measurements was 50, and the average fineness, the minimum fineness and the maximum fineness were 3.1 dtex, 0.9 dtex and 5.2 dtex, respectively, where they had a standard deviation of 1.06 and had a single-peak distribution with the peak at the center.

As is found from the comparison with Comparative Example 2 described below, it was confirmed that the average fineness of the single fibrils of this example was small and the fineness was uniform, and they had a single-peak distribution with the peak at the center.

Comparative Example 2

A PTFE filament was obtained under the same conditions as those in Working Example 5 except that the emboss processing was not performed. The fineness of the PTFE filament was 32.6 dtex, which was about four times the fineness of Working Example 5.

Figure 9:
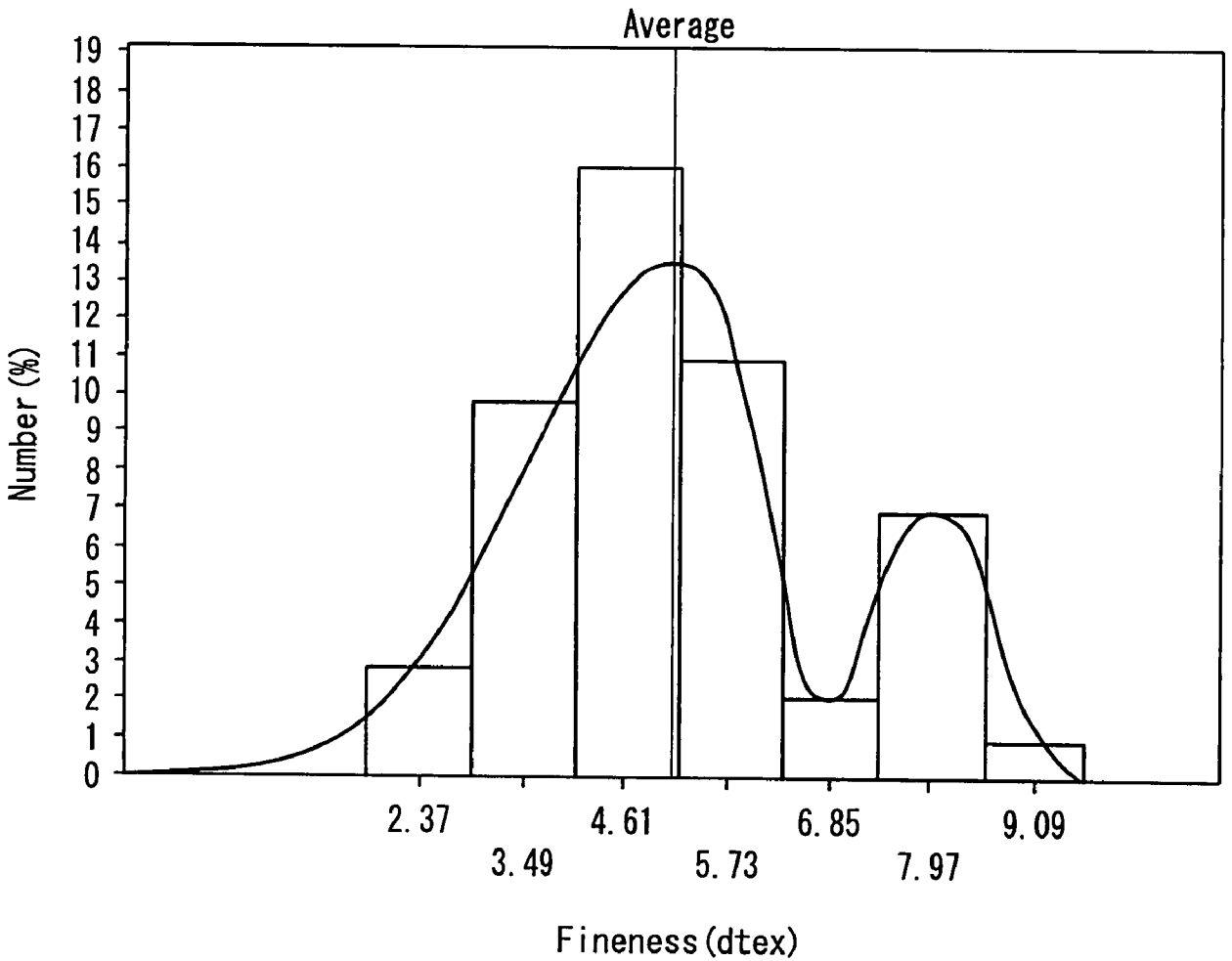
FIG. 9 is a graph showing the fineness distribution of single fibrils of the filament obtained from Comparative Example 2.

When the fineness distribution of single fibrils of the thus obtained filament was measured, the distribution shown by the graph of FIG. 9 was obtained. The number of measurements was 50, and the average fineness, the minimum fineness and the maximum fineness were 5.1 dtex, 2.4 dtex and 9.1 dtex, respectively, where they had a standard deviation of 1.52 dtex and a non-uniform distribution of fineness. Furthermore, the network structure of single fibrils had an unstable shape and its size was random as shown in FIG. 10.

Table 1 shows the results of the above-described Working Examples 1 to 5 and Comparative Examples 1 and 2. In Table 1, the fineness, the strength and the elongation percentage of PTFE fibers were determined in accordance with JIS L1015.

On the other hand, when the films on which emboss processing was not performed were opened, the fineness of the obtained fibers was large, as is evident from the comparisons between Working Example 3 and Comparative Example 1 and between Working Example 5 and Comparative Example 2. Furthermore, the texture of the generated fibers was slightly stiff. Moreover, the network structure of the filament was random, and therefore the distribution of the number of branches of the short fibers that were obtained by cutting this filament was broad, which leads to deterioration in the processing stability of the short fibers.

In addition to that, Working Examples of the present invention have the following advantages: since the opening by slitting of the emboss-processed film can be conducted more smoothly as compared with the film on which no emboss processing is conducted, the opening of a broad film can be conducted easily as well. Furthermore, the end portions of the film also can be used effectively, which can lessen the loss of the manufacturing of the filament and can lead to a high production yield.

TABLE 1

| Stretching magnification of PTFE film*1 | Emboss processing of PTFE film | Fineness (dtex) | Strength (CN/dtex) | Elongation percentage % | Density (g/cm$^3$) | Appearance of fiber (number of branches/70 mm)*2 |
|---|---|---|---|---|---|---|
| Ex. 1 LD: ×12 | Processed | 13.3 | 0.9 | 6.0 | 2.05 | Regular network structure (3 to 5) |
| Ex. 2 LD: ×9 | Processed | 17.8 | 0.8 | 6.8 | 2.10 | Regular network structure (3 to 5) |
| Ex. 3 LD: ×6 | Processed | 24.2 | 0.7 | 6.5 | 2.15 | Regular network structure (3 to 5) |
| Comparative Ex. 1 LD: ×6 | Not processed | 42.3 | 0.7 | 6.5 | 2.15 | Random network structure (1 to 5) |
| Ex. 4 LD: ×8 TD: ×3 | Processed | 4.2 | 1.1 | 5.2 | 1.62 | Regular network structure (2 to 4) |
| Ex.5 LD: ×6 TD: ×2 | Processed | 7.8 | 0.8 | 7.2 | 1.65 | Regular network structure (2 to 4) |
| Comparative Ex. 2 LD: ×6 TD: ×2 | Not processed | 32.6 | 0.6 | 7.4 | 1.70 | Random network structure (1 to 5) |

(Remarks)
*1LD concerns the stretching in the lengthwise direction of the film (numerical value represents the stretching magnification) and TD concerns the stretching in the width direction of the film (numerical value represents the stretching magnification).
*2The number of branches was measured by cutting the generated fiber into a length of 70 mm.

As is evident from Table 1, the application of emboss processing to the supplied film facilitates the opening of the film and allows the film to be made finer, and a flexible PTFE filament can be obtained. Furthermore, the biaxially oriented film also can be opened easily. Since the porosity of the biaxially oriented film is higher, a filament with a reduced density by about 20% than the case of a uniaxially oriented film can be manufactured.

Furthermore, the short fibers having a branch structure, which were obtained by cutting the thus obtained filament into a length of 70 mm by a cutter, had a uniform number of branches and were uniform in length of the branches as shown in FIG. 5, which leads to an advantage of the enhancement of the processing stability when an article is manufactured from the fibers.

Short fibers obtained by cutting the PTFE filament of the present invention have a branch structure, and are particularly effective for high-temperature resistant felt, printed boards, battery separators and webs and prepregs for bag filters, in addition to the above-stated applications.

The PTFE filament of the present invention can be twined so as to be used for a high-strength fabric, surgical sutures and the like. Especially, a fiber obtained from a biaxially oriented film can have a reduced density, and therefore is effective for reducing a weight of its finished articles and the manufacturing cost.

A network structure that is one of the features of the PTFE filament of the present invention is effective for manufacturing finished articles impregnated with resins and oils. In sealing materials obtained from twines and by further braiding the twines, when the sealing materials are impregnated with a resin dispersion solution, an oil and the like, the penetration into the inside of the sealing materials can be promoted, thus enhancing the properties of holding the impregnation material.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. An oriented polytetrafluoroethylene (PTFE) slit film fiber comprising a filament having a surface in which an impression of a shape by emboss processing remains on a topside or a bottom side or both sides, wherein the shape surface is longitudinal, a zigzag shaped or a convex concave shaped impression remains on the shape surface, the filament comprises a network structure in which single fibrils that are opened partially are arranged regularly, and the slit film fiber is flat and has a thickness of 5 microns to 450 microns.

2. The PTFE fiber according to claim 1, wherein the PTFE fiber is semi-baked or baked PTFE.

3. The PTFE fiber according to claim 1, wherein the PTFE oriented film is a uniaxially oriented film.

4. The PTFE fiber according to claim 3, wherein the uniaxially oriented film is stretched by 4 times or more in the lengthwise direction of the film.

5. The PTFE fiber according to claim 1, wherein the PTFE oriented film is a biaxially oriented film.

6. The PTFE fiber according to claim 5, wherein the biaxially oriented film is stretched by 4 times or wore in the lengthwise direction of the film and by 1.5 times to 5 times in the width direction of the flim.

7. The PTFE fiber according to claim 1, wherein a fineness of the PTFE filament is from 0.5 dtex to 600 dtex.

8. The PTFE fiber according to claim 1, wherein the PTFE fiber has a flax shape and a thickness ranges from 5 μm to 450 μm.

9. The PTEE fiber according to claim 1, wherein an average fineness of the single fibrils constituting the PTFE fiber is 4.5 dtex or less.

10. The PTEE fiber according to claim 1, wherein a distribution of fineness of the single fibrils constituting the PTFE fiber is a single-peak distribution with the peak at a center.

11. A PTFE fiber comprising a short fiber including a branch structure that is obtained by cutting the filament according to claim 1.

* * * * *